US010934667B2

(12) United States Patent
Kirk

(10) Patent No.: US 10,934,667 B2
(45) Date of Patent: Mar. 2, 2021

(54) HYDRO-EXCAVATION PLUG

(71) Applicant: Dale Kirk, Lapeer, MI (US)

(72) Inventor: Dale Kirk, Lapeer, MI (US)

( * ) Notice: Subject to any disclaimer, the term of this patent is extended or adjusted under 35 U.S.C. 154(b) by 91 days.

(21) Appl. No.: 16/281,393

(22) Filed: Feb. 21, 2019

(65) Prior Publication Data

US 2020/0270820 A1 Aug. 27, 2020

(51) Int. Cl.

| | |
|---|---|
| ***E02D 29/14*** | (2006.01) |
| ***E01C 9/08*** | (2006.01) |
| ***E21B 7/04*** | (2006.01) |
| ***E21B 7/18*** | (2006.01) |
| ***E02F 5/00*** | (2006.01) |
| ***E02F 5/20*** | (2006.01) |
| ***E01C 11/00*** | (2006.01) |

(52) U.S. Cl.

CPC ..... *E01C 9/083* (2013.01); *E01C 11/005* (2013.01); *E02F 5/003* (2013.01); *E02F 5/20* (2013.01); *E21B 7/04* (2013.01); *E21B 7/18* (2013.01)

(58) Field of Classification Search

CPC ..... E01C 9/083; E01C 11/005; E02F 5/003; E02F 5/20; E21B 7/04; E21B 7/18; E02D 29/14

USPC ..... 404/25, 26; 52/19, 20

See application file for complete search history.

(56) References Cited

U.S. PATENT DOCUMENTS

| | | | | |
|---|---|---|---|---|
| 2,354,857 | A * | 8/1944 | Gits | G09F 7/165 40/616 |
| 3,046,853 | A * | 7/1962 | Legendre | E02D 29/14 404/25 |
| 4,101,154 | A * | 7/1978 | Kagstrom | E02D 29/1427 292/237 |
| 4,262,701 | A | 4/1981 | Beacom | |
| 4,302,125 | A * | 11/1981 | Cullen, Jr. | E01F 9/553 404/15 |
| 4,408,421 | A * | 10/1983 | Pai | E02D 29/1409 404/26 |
| 4,655,913 | A * | 4/1987 | Boersma | E03C 1/264 210/163 |
| 4,861,186 | A * | 8/1989 | Ferns | E02D 29/14 404/25 |
| 5,312,202 | A * | 5/1994 | Newton | E02D 29/14 404/25 |
| 5,525,006 | A * | 6/1996 | Kilman | E02D 29/12 404/25 |
| 5,979,117 | A * | 11/1999 | Fuller | E02D 29/14 404/25 |
| 6,584,734 | B2 * | 7/2003 | Mihalicz | E01C 23/06 404/25 |
| 6,739,796 | B1 * | 5/2004 | Del Nero | E02D 29/1427 404/25 |
| 7,540,683 | B2 * | 6/2009 | Salas | E03B 7/095 404/25 |

(Continued)

*Primary Examiner* — Raymond W Addie
(74) *Attorney, Agent, or Firm* — Harness, Dickey & Pierce, P.L.C.

(57) ABSTRACT

A plug device for covering a cavity excavated in the ground. The plug device includes a head defined by a plate having a planar upper surface and a planar lower surface, wherein the plate has a size that corresponds to a size of the excavated cavity. The plug device also includes a plurality of anchor members extending axially away from the planar lower surface, and that are configured to secure the plug device to the cavity.

13 Claims, 4 Drawing Sheets

(56) References Cited

U.S. PATENT DOCUMENTS

| | | | | |
|---|---|---|---|---|
| 7,862,729 | B2 * | 1/2011 | Stetson | E02D 29/14 210/767 |
| 7,887,257 | B2 * | 2/2011 | Shaw | E03F 5/0404 405/52 |
| 7,975,436 | B2 * | 7/2011 | Newton | H02G 9/025 52/20 |
| 8,851,789 | B2 * | 10/2014 | Bax | E02D 29/14 404/25 |
| 9,593,457 | B2 * | 3/2017 | Buckner | E02D 3/00 |
| 2003/0143038 | A1 * | 7/2003 | Babcock | E02D 5/808 405/259.1 |
| 2008/0075532 | A1 * | 3/2008 | Boyd | E02D 17/10 404/25 |
| 2015/0376860 | A1 * | 12/2015 | Saeki | E02D 29/149 404/25 |

* cited by examiner

HYDRO-EXCAVATION PLUG

FIELD

The present disclosure relates to a hydro-excavation plug.

BACKGROUND

This section provides background information related to the present disclosure which is not necessarily prior art.

Potholing or daylighting is the process of digging a test hole to expose underground utilities to check the utilities for cracks, leaks, or any kind of damage, as well as to confirm the location of the underground utilities. The correct location of the utilities is important to know before conducting more expansive excavation using heavy machinery, or before conducting other excavating processes such as directional boring, which is a minimal impact trenchless method of installing underground pipe, conduit, or cables in a relatively shallow arc or radius along a prescribed underground bore path by using a surface-launched drilling rig. In this regard, it is desirable to avoid severing or damaging the existing underground utilities during excavation or during boring. Accordingly, efforts are made to confirm the location of the underground utilities before conducting the more expansive excavation or boring.

Traditionally, potholing or daylighting is accomplished using a backhoe, or by hand or shovel digging. If the potholing or daylighting is occurring in a roadway, however, these traditional excavation methods are time-consuming and substantially damage the roadway such that the roadway is required to be closed to traffic for an extended period of time until the potholing or daylighting can be completed and the damaged roadway can be repaired. This inconveniences drivers, and raises costs due to the cost required to repair the roadway.

With the development of hydro-excavation, however, nearly all of the downsides of traditional potholing and daylighting excavation methods are avoided. In this regard, hydro-excavation is the process of precisely removing or moving soil with pressurized water. The pressurized water is accurately provided from a user-operated wand, and cuts through the soil and breaks it up. Then an air conveyance system or vacuum system is used to transfer the broken up soil and water (i.e., slurry) to a debris tank. While hydro-excavation can be used for a number of different excavation tasks, hydro-excavation has been found to be a non-destructive and more accurate way to excavate soil when locating underground utilities (i.e., potholing or daylighting) because using hydro-excavation avoids damage to the underground pipes, lines, and cables that were previously subject to damage when using mechanical excavating techniques such as using a backhoe or by hand or shovel digging.

In addition, because the pressurized water can be accurately provided to the excavation site, the cavity that forms during removal of the soil can be made much smaller in comparison to a mechanically excavated cavity. Thus, hydro-excavation is beneficial for reducing traffic congestion when the potholing or daylighting is conducted in a roadway because the excavation can be conducted more quickly, and in a much smaller area in comparison to traditional excavation techniques.

Notwithstanding the benefits of using hydro-excavation during potholing or daylighting, when hydro-excavation is used in a roadway, there still remains a need to repair the roadway before traffic can be allowed to pass over the excavation site. This can require additional time that the roadway remains closed or under construction. There is a need, therefore, for a solution that results in the roadway being reopened to traffic more quickly after conducting the potholing or daylighting using hydro-excavation.

SUMMARY

This section provides a general summary of the disclosure, and is not a comprehensive disclosure of its full scope or all of its features.

The present disclosure provides a plug device for covering a cavity excavated in the ground. The plug device includes a head defined by a plate having a planar upper surface and a planar lower surface, wherein the plate has a size that corresponds to a size of the excavated cavity, and wherein a plurality of anchor members extend axially away from the planar lower surface and are configured to secure the plug device to the cavity.

The plate may be circular, and the plurality of anchor members may be positioned about a circumference of the plate.

The plurality of anchor members may be located at positions that correspond to about 0 degrees, about 30 degrees, about 150 degrees, about 180 degrees, about 210 degrees, and about 330 degrees of the circumference of the circular plate.

The plug device may include a gusset between each anchor member and the plate, and each anchor member may be a cylindrical rod.

The plate may include at least one aperture that extends from the planar upper surface to the planar lower surface, and that is configured for receipt of a device configured to locate and remove the plug device in the cavity.

The plate and anchor members may be formed of a rigid metal material such as steel.

The present disclosure also provides a method that includes conducting a first excavation process that includes forming a cavity in the ground to uncover and determine or confirm the location of underground utilities; temporarily covering the cavity with a plug device; after uncovering and determining or confirming the location of the underground utilities, conducting a second excavation process; and after conducting the second excavation process, removing the plug device from the cavity, wherein the plug device includes a head defined by a plate having a planar upper surface and a planar lower surface, the plate having a size that corresponds to a size of the cavity, and the plug device includes a plurality of anchor members extending axially away from the planar lower surface and configured to secure the plug device to the cavity.

The method may further include filling the cavity with a filler material before temporarily covering the cavity with a plug device, and the first excavation process may include forming the cavity using a hydro-excavation apparatus.

In the method, the second excavation process may include conducting directional boring.

In the method, the first excavation process can include forming the cavity in a roadway.

When the cavity is formed in a roadway, the temporary covering of the cavity with the plug device allows for the roadway to be open to traffic before conducting the second excavation process.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
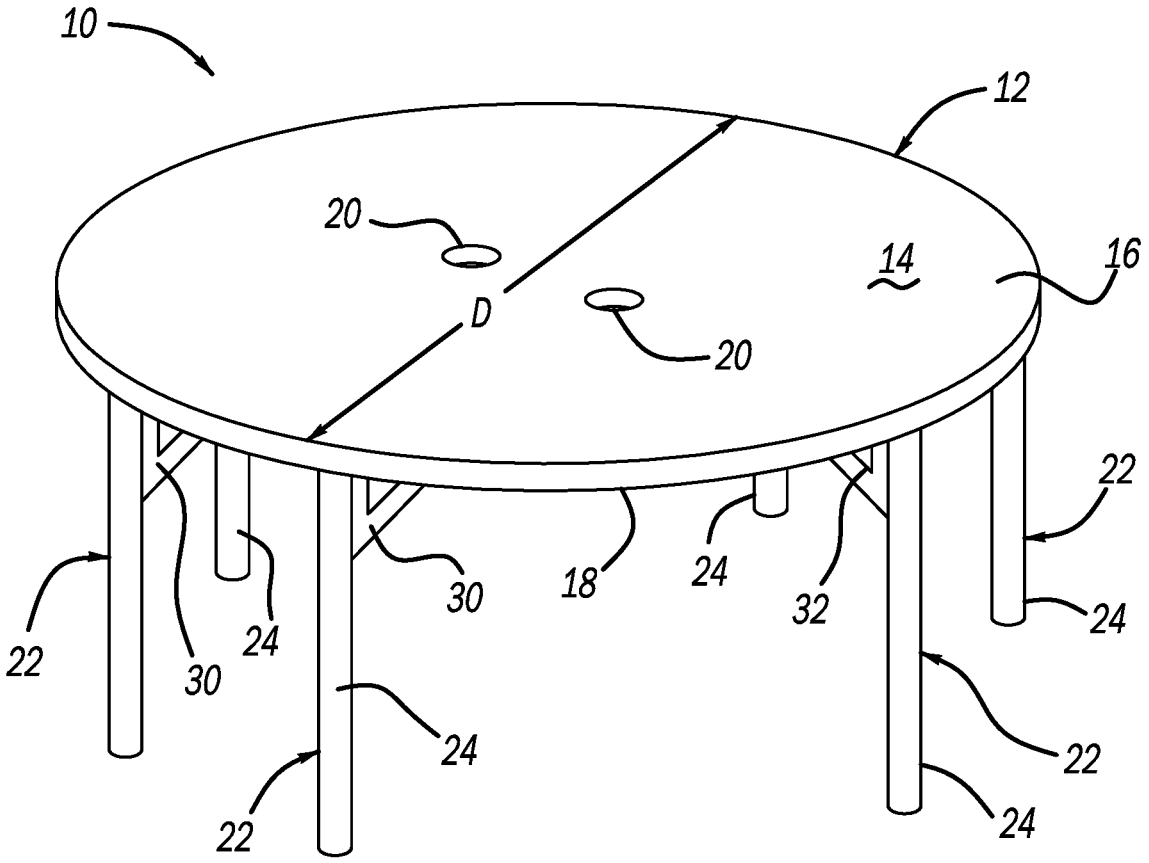
FIG. 1 is a perspective view of a plug according to a principle of the present disclosure.

FIG. 1 illustrates a plug device 10 according to a principle of the present disclosure. Plug device 10 includes a cover or head 12 that is configured to enclose a cavity that is produced during excavation. In the illustrated embodiment, head 12 is a circular plate 14 that is formed of a rigid material such as steel or some other type of metal material. A diameter D of plate 14 ranges between about twelve inches to about twenty-four inches. Preferably diameter D is between about sixteen inches to about twenty inches. In the illustrated embodiment, diameter D of plate 14 is about eighteen inches. Although plate 14 is illustrated as being circular, it should be understood that additional shapes (e.g., oval, square, rectangular, etc.) are contemplated by the present disclosure.

Plate 14 includes an upper surface 16 and a lower surface 18. A pair of apertures 20 penetrate the plate 14 from upper surface 16 to lower surface 18. Because plate 14 is formed of steel, plug device 10 can be relatively heavy and difficult to lift manually. Apertures 20, therefore, are configured to mate with a hooked cable or winch (not illustrated) that allows for plug device 10 to be easily lifted and moved, as will be described in more detail later. In the illustrated embodiment, apertures 20 have a diameter of about 1.5 inches, and are separated by a distance of two inches.

Figure 2:
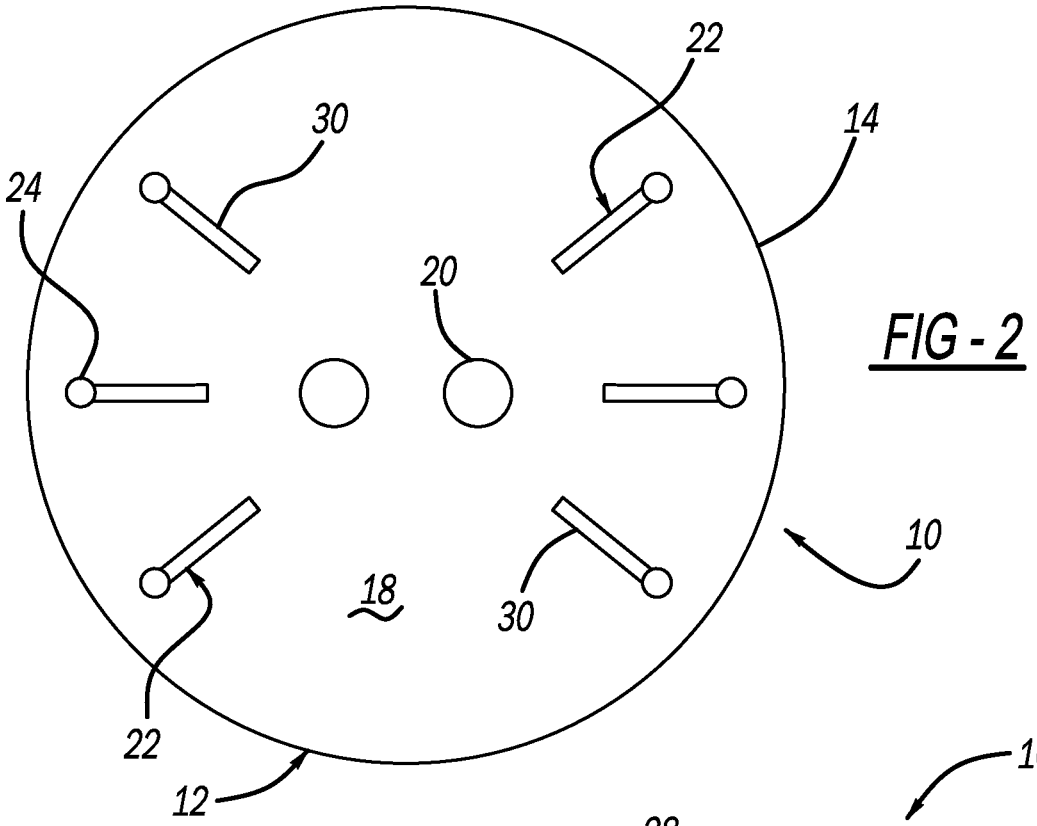
FIG. 2 is a bottom-perspective view of the plug illustrated in FIG. 1.
Figure 3:
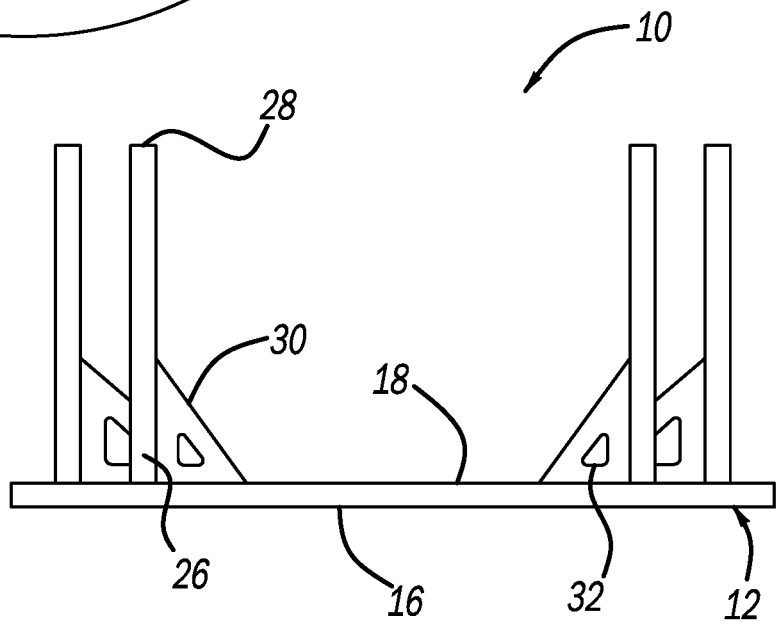
FIG. 3 is a side-perspective view of the plug illustrated in FIG. 1.
Figure 4:
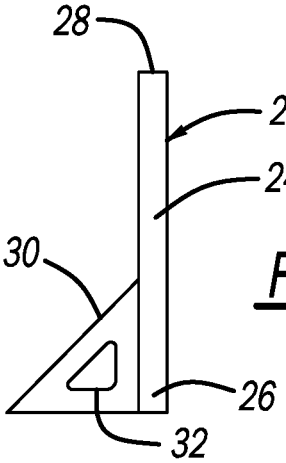
FIG. 4 is a side-perspective view of an anchor structure of the plug illustrated in FIG. 1.

Plug device 10 includes a plurality of anchor members 22 that extend axially in a direction away from lower surface 18 of plate 14. As best shown in FIGS. 2 and 3, anchor members 22 are formed by cylindrical rods 24 that each have a length L of about eight inches. Rods 24, however, may each have different lengths, or have a length L that is greater or lesser than eight inches. Rods 24 may be formed of the same material as plate 14. Rods 24, therefore, are preferably formed of steel or some other type of metal material. Although rods 24 are preferably solid (i.e., not hollow), the present disclosure contemplates the use of hollow cylindrical (e.g., tubular) rods without departing from the scope of the present disclosure. In addition, rods 24 are not necessarily cylindrical, but may also be cone-shaped or parallelepiped-shaped. In the illustrated embodiment, rods 24 are formed of ⅝ inch solid steel posts.

As best shown in FIG. 3, rods 24 extend substantially orthogonally relative to plate 14. It is contemplated, however, that rods 24 may be slightly non-orthogonally angled relative to plate 14. In this regard, rods 24 each include a proximal end 26 attached to lower surface 18 of plate 14 and a distal end 28 located axially away from lower surface 18 of plate 14. When rods 24 are non-orthogonally angled relative to plate 14, rods 24 extends axially and radially away from plate 14 such that distal end 28 is located more radially outward or radially inward relative to plate 14 than proximal end 26.

Rods 24 are rigidly attached to plate 14 by welding, or any other rigid attachment method known to one skilled in the art. In addition, a gusset 30 may be used to provide additional structural support between plate 14 and rod 24. Gussets 30 may also be formed of steel or some other type of metal material, and are preferably welded to each of plate 14 and rod 24. In the illustrated embodiment, gussets 30 are triangular-shaped and include an aperture 32. It should be understood, however, that aperture 32 is optional, and that gussets 30 may have any other shape known to one skilled in the art.

In the illustrated embodiment (FIG. 2), there are six anchor members 22 that are located at 0 degrees, 45 degrees, 135 degrees, 180 degrees, 225 degrees, and 315 degrees about circular plate 14. While the anchor members 22 are preferably located at these locations, it should be understood that a greater or less number of anchor members 22 can be used without departing from the scope of the present disclosure. For example, there may be twelve anchor members 22 spaced apart every 30 degrees, or there may be four anchor members spaced apart every 90 degrees about circular plate 14. Alternatively, the six anchor members 22 illustrated could be evenly distributed every 60 degrees about circular plate 14 without departing from the scope of the present disclosure. Regardless of the number of anchor members 22 that are used, it should be understood that anchor members 22 have the length L and rigidity that assists in maintaining plug device 10 safely anchored within the ground to cover an excavated cavity and prevent disengagement with the ground in the event of being struck by a vehicle tire, as will be described in more detail below.

Figure 5:
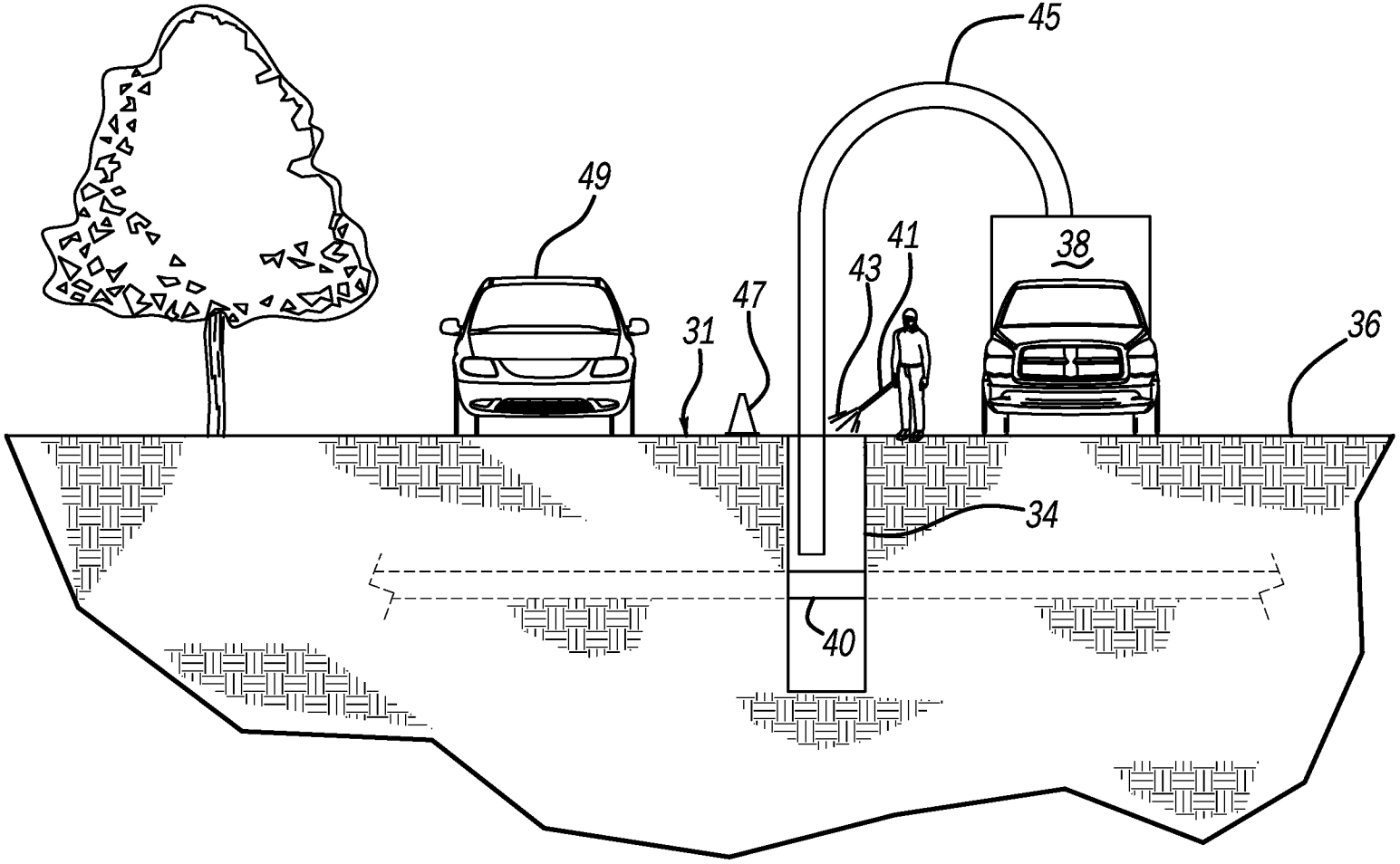
FIG. 5 illustrates various steps of a method of using the plug device illustrated in FIG. 1.
Figure 6:
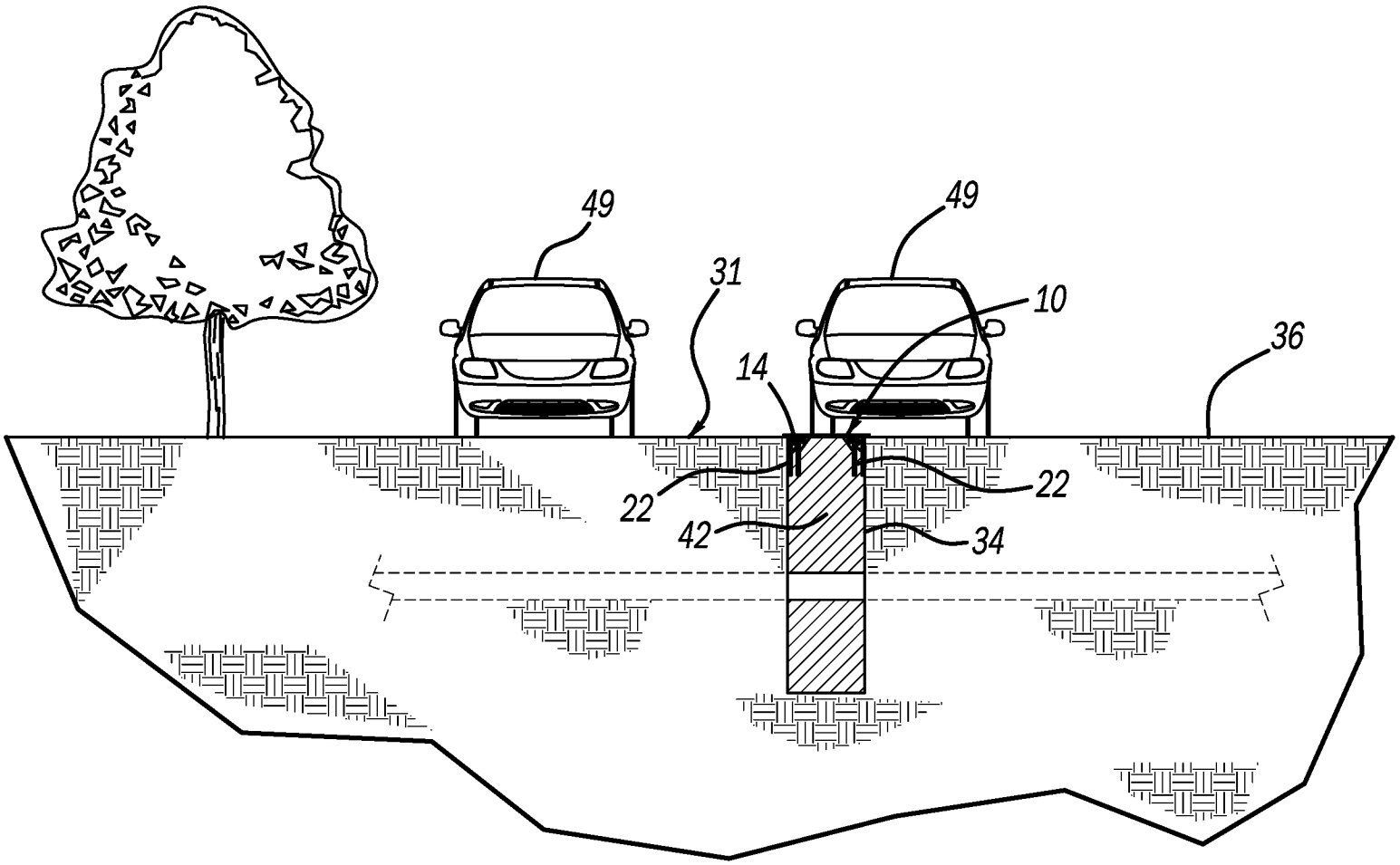
FIG. 6 illustrates various additional steps of the method of using the plug device illustrated in FIG. 1.

Now referring to FIGS. 5 and 6, an example method that utilizes plug device 10 will be described. The example method described below is directed to an instance when directional boring is required to be completed underneath a roadway 31, which requires that the location of underground utilities beneath the roadway be confirmed prior to conducting the directional boring so that the underground utilities are not severed or damaged during the directional boring. As illustrated in FIG. 5, a cavity 34 has been excavated in the ground 36 using, for example, a hydro-excavation apparatus 38 to expose the underground utilities 40 that may be, for example, an electrical line, a gas line, a water line, a sewer line, a fiber-optic cable, or any other type of utility known to one skilled in the art. Because cavity 34 is formed by hydro-excavation apparatus 38, the diameter and depth of cavity 34 can be precisely controlled due to the use of a wand 41 that allows the pressurized water 43 to accurately break up the soil, which is then evacuated using vacuum tube 45 that transfers the excavated soil to a tank (not shown) in hydro-excavation apparatus 38. Inasmuch as the location of cavity 34 is in a roadway 31, the roadway is required to be closed to vehicle 49 traffic, or at least partially blocked to vehicle 49 traffic (see, e.g., traffic cones 47), while hydro-excavation apparatus 38 is used to form cavity 34 and expose underground utilities 40.

After confirming the location of the underground utilities 40, the directional boring underneath the roadway can be completed. Because directional boring can be completed without closing or at least partially blocking the roadway 31, it is unnecessary to leave the exposed cavity 34 in the roadway. Thus, according to the present disclosure, the cavity 34 is filled with soil or some other filler material 42 up to ground level 36. Then, plug device 10 is located over cavity 34 and anchor members 22 are driven into the filler material 42 to secure plug device 10 over cavity 34 by striking plate 14 with mallets or some other type of driving device. Because anchor members 22 have a sufficient length that is driven into filler material 42 and because plate 14 is substantially co-planar with the roadway 31, plug device 10 is safely secured and prevented from being disengaged from cavity 34 when subjected to a tire strike by a vehicle 49 using the roadway 31. Because the roadway 31 can be safely reopened before conducting the directional boring, the amount of time that the roadway 31 is closed or at least partially blocked can be substantially reduced in comparison to prior methods that used mechanical excavation that yielded a cavity 34 that was too large to be safely covered and allow for traffic to pass over the covered cavity 34.

Moreover, it should be understood that plug device 10 is a reusable device. In this regard, after the directional boring has been completed, the roadway 31 can again be temporarily closed or partially blocked, and plug device 10 can be removed from cavity 34. This is accomplished by affixing or connecting a hooked cable or winch (not shown) to apertures 20 and lifting plug device 10 to disengage anchor members 22 from filler material 42. The cavity 34 in the roadway 31 can then be repaved, as needed. This may also be accomplished at off hours, so that traffic is affected only to a minor extent.

While the above example method using plug device 10 has been described relative to covering a cavity 34 formed in a roadway 31 after conducting potholing or daylighting and before conducting directional boring, the present disclosure should not be limited thereto. In this regard, plug device 10 may also be used to safely cover cavities 34 that are not formed in a roadway 31. For example, if a cavity 34 is formed while performing a landscaping service away from a roadway 31, or when performing repairs to underground utilities 40 located away from a roadway 31, cavity 34 may be temporarily covered using plug device 10 and without filling cavity 34 with filler material 42. In such a case, anchor members 22 should extend axially away from plate 14 and radially outward from plate 14 such that anchor members 22 can engage with side surfaces 44 of cavity. Then, when the work is to be completed, plug device 10 can be removed, the work completed, and cavity 34 refilled with filler material 42.

It should be understood that while plug device 10 has been described as beneficial when used in instances when a diameter of cavity 34 can be precisely controlled (i.e., when formed by hydro-excavation), the present disclosure should not be limited to only instances when the cavity 34 is hydro-excavated. That is, plug device 10 can be used when cavity 34 is formed using an auger, hand dug, or some other mechanical method where a diameter of cavity 34 is precisely controlled.

Moreover, it should be understood that a diameter D of plate 14 and a length L of anchor members 22 are variable. The above-noted dimensions are described as preferable due to the ease with which plug device 10 can be inserted and removed from cavity 34, and due to the ease with which plug device 10 can be stored for reuse on, for example, a hydro-excavator apparatus 38 or vehicle. Inasmuch as the dimensions are variable, plug device 10 can be sized for use when large-diameter cavities 34 are excavated using, for example, a backhoe.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A plug device for covering a cavity excavated in the ground, the plug device comprising:

a head defined by a plate having a planar upper surface and a planar lower surface, the plate having a size that corresponds to a size of the excavated cavity; and a plurality of anchor members extending axially away from the planar lower surface and configured to secure the plug device to the cavity, wherein each anchor member is a cylindrical rod, and wherein the plurality of anchor members are located at positions that correspond to about 0 degrees, about 30 degrees, about 150 degrees, about 180 degrees, about 210 degrees, and about 330 degrees of the circumference of the plate.

2. The plug device according to claim 1, wherein the plate is circular.

3. The plug device according to claim 1, wherein the plate includes at least one aperture that extends from the planar upper surface to the planar lower surface that is configured for receipt of a device configured to locate and remove the plug device in the cavity.

4. The plug device according to claim 1, wherein the plate and anchor members are formed of a rigid metal material.

5. The plug device according to claim 1, further comprising a gusset between each anchor member and the plate.

6. The plug device according to claim 5, wherein the gusset is a triangular member having a triangular aperture formed therein, one side of the triangular member extends along a length of the anchor member, and a side of the triangular member that is adjacent to the one side extends along the planar lower surface of the plate.

7. A method comprising:

conducting a first excavation process that includes forming a cavity in the ground to uncover and determine or confirm the location of underground utilities;

temporarily covering the cavity with a plug device;

after uncovering and determining or confirming the location of the underground utilities, conducting a second excavation process; and after conducting the second excavation process, removing the plug device from the cavity, wherein the plug device includes a head defined by a plate having a planar upper surface and a planar lower surface, the plate having a size that corresponds to a size of the cavity, and the plug device includes a plurality of anchor members extending axially away from the planar lower surface and configured to secure the plug device to the cavity, wherein each anchor member is a cylindrical rod, and wherein the plurality of anchor members are located at positions that correspond to about 0 degrees, about 30 degrees, about 150 degrees, about 180 degrees, about 210 degrees, and about 330 degrees of the circumference of the plate.

8. The method according to claim 7, further comprising filling the cavity with a filler material before temporarily covering the cavity with the plug device.

9. The method according to claim 7, wherein the first excavation process includes forming the cavity using a hydro-excavation apparatus.

10. The method according to claim 7, wherein the second excavation process includes conducting directional boring.

11. The method according to claim 7, wherein the first excavation process includes forming the cavity in a roadway.

12. The method according to claim 11, wherein the temporary covering of the cavity with the plug device allows for the roadway to be open to traffic before conducting the second excavation process.

13. The method of claim 7, wherein the plug device includes a gusset member between each anchor member and the plate, each gusset being a triangular member having a triangular aperture formed therein, one side of the triangular member extends along a length of the anchor member, and a side of the triangular member that is adjacent to the one side extends along the planar lower surface of the plate.

* * * * *